US007287477B2

(12) United States Patent
Gounder

(10) Patent No.: US 7,287,477 B2
(45) Date of Patent: Oct. 30, 2007

(54) CYCLONE BYPASS FOR A CIRCULATING FLUIDIZED BED REACTOR

(75) Inventor: Ponnusami K. Gounder, Easton, PA (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 0 days.

(21) Appl. No.: 10/962,590

(22) Filed: Oct. 13, 2004

(65) Prior Publication Data

US 2006/0075946 A1 Apr. 13, 2006

(51) Int. Cl.
*F23J 15/00* (2006.01)
*F23G 5/30* (2006.01)
*F27B 15/10* (2006.01)

(52) U.S. Cl. ..... 110/345; 110/216; 110/245; 432/15; 122/4 D

(58) Field of Classification Search ..... 122/4 D; 422/147; 110/216, 245; 165/104.16; 432/15
See application file for complete search history.

(56) References Cited

U.S. PATENT DOCUMENTS 4,419,964 A * 12/1983 Enkegaard ..... 122/4 D
4,552,097 A * 11/1985 Jarmuzewski ..... 122/4 D
4,683,840 A * 8/1987 Morin ..... 122/4 D
4,733,621 A 3/1988 Kostamo et al. ..... 110/347
4,741,290 A * 5/1988 Krieger et al. ..... 122/4 D
5,159,886 A 11/1992 Schaub et al. ..... 110/347
5,281,398 A 1/1994 Hyppanen et al. ..... 422/147
6,457,425 B1 * 10/2002 Crafton et al. ..... 110/346

OTHER PUBLICATIONS

International Search Report dated Jan. 11, 2006, which was mailed in a Communication dated Jan. 26, 2006, and which issued in corresponding International Application No. PCT/IB2005/002987.
Written Opinion of the International Searching Authority mailed Jan. 26, 2006, issued in International Application No. PCT/IB2005/002987.

* cited by examiner

*Primary Examiner*—Kenneth Rinehart
(74) *Attorney, Agent, or Firm*—Fitzpatrick, Cella, Harper & Scinto

(57) ABSTRACT

A method of and an apparatus for operating a circulating fluidized bed reactor having a furnace with a discharge port for exhaust gas, and a particle separator having an inlet connected to the exhaust gas discharge port and an outlet duct for the exhaust gas and a return duct for separated solids. The method includes the steps of arranging a bypass duct bypassing the particle separator, and conducting a partial flow of exhaust gas along the duct for increasing the fly ash content in the exhaust gas after the separator. The bypass duct is advantageously provided with means for controlling the flow of exhaust gas in the bypass duct.

9 Claims, 4 Drawing Sheets

CYCLONE BYPASS FOR A CIRCULATING FLUIDIZED BED REACTOR

BACKGROUND OF THE INVENTION

1. Field of the Invention

The present invention relates to a method of and an apparatus for operating a circulating fluidized bed reactor having a separator for separating entrained solid particles from the exhaust gas and recycling the separated particles to the combustion chamber. The invention particularly relates to the composition of the bed material, and seeks to solve problems relating to the control of bed inventory and bottom ash quantity.

2. Description of the Related Art

Circulating fluidized bed reactors have been used for decades and are known to those skilled in the art of power generation, for instance. The circulating fluidized bed reactors may be gasifiers, combustors, steam generators, or any other similar type of apparatus as those skilled in the art will recognize. The fluidized bed reactors normally have an upright furnace, or reaction chamber, to the lower part of which the fuel is introduced. Primary and secondary gases, usually air, are supplied through the bottom and the sidewalls of the furnace. The combustion of the fuel takes place in a fast fluidized bed, which , in addition to fuel particles, usually also contains limestone.

A particle separator is in communication with the upper end of the furnace through a discharge port. A discharge duct connects the discharge port with the particle separator. Hot exhaust gas is discharged from the furnace, and flows through the discharge port and the discharge duct into the particle separator. The particle separator of a circulating fluidized bed boiler is usually a cyclone. When using a cyclone, the discharge duct transmits the exhaust gas with entrained solid particles tangentially into the upper portion of the cyclone separator. The cyclone separator, or other particle separator, for example, an impact separator, separates solid particles from the hot exhaust gas, which solid particles are gravity-fed to the lower end of the separator.

The lower end of the particle separator, wherein the solid particles are collected, is connected to the upper end of a vertical return duct. The opposite or lower end of the return duct has an outlet connected to the furnace for returning the separated solid particles from the particle separator to the furnace. Solid particles removed from the bottom of the furnace are referred to as bottom ash, whereas the portion of the solid material leaving the particle separator with the exhaust gases is called fly ash.

Circulating fluidized bed boilers having particle separators, for example, of the cyclone type, for separating entrained solid particles from exhaust gas and recycling the separated particles back to the combustion chamber of the boiler are well known. Examples of such systems are set forth in U.S. Pat. Nos. 4,733,621 and 5,281,398. In the former patent, the particles separated in the cyclone separator are recycled to the boiler through a split loop seal. U.S. Pat. No. 5,281,398 discloses a centrifugal separator made of flat watertube panels. This type of cyclone can be integrated with the furnace so that there is no discharge duct between the furnace and the cyclone.

The cyclone separators for circulating fluidized bed reactors have been improved over the past decades so that they have become very efficient. In normal running conditions, they may separate about 99.9 percent of the solid material leaving the combustion chamber with the exhaust gas. An efficient separation of solid particles from exhaust gases is always a property worth striving for. For instance, the better efficiency the separation has, the higher is the combustion efficiency. However, very high separation efficiency may also bring about some problems or drawbacks in the process. For instance, it may lead to a high bottom ash content compared to fly ash. When the proportion of bottom ash is high, an efficient bottom ash removal is required to maintain the required bed inventory (i.e., the composition of the bed material) in proper condition.

Since the temperature of the bottom ash is on the order of about 600 to about 900° C., ash coolers are needed to bring the ash temperature down to about 300° C., so that the ash may be safely discharged from the reactor. The more bottom ash that has to be removed from the reactor, the more expensive (i.e., of higher capacity) the equipment for both the discharge and the cooling of the bottom ash that is required.

Very high separation efficiency may also become a problem, e.g., when the quality of fuel varies in a way leading to the formation of an excessive amount of fine particles in the bed. If the particle separator recirculates a very high proportion of the fine particles, the resulting high fine particle bed inventory may lead, e.g., to a very high heat transfer efficiency in the furnace. If the heat transfer rate exceeds its designed value, the bed has a tendency to cool to a lower temperature, leading, e.g., to increased emissions to the environment.

SUMMARY OF THE INVENTION

The present invention provides an improved method of and an apparatus for operating a circulating fluidized bed reactor.

According to one aspect, the present invention provides a method of operating a circulating fluidized bed reactor having a furnace with a discharge port for exhaust gas, a particle separator connected to the discharge port and having an outlet for the exhaust gas and a return duct for the separated solids. The method comprises the steps of arranging a bypass duct bypassing the particle separator, and conducting a partial flow of exhaust gas along the duct for increasing the fly ash content in the exhaust gas after the separator.

In accordance with this method, the exhaust gas stream bypassing the particle separator decreases the amount of solid particles separated by the separator, whereby the solids inventory and the accumulation of bottom ash in the furnace are decreased.

According to another aspect, the present invention, provides an apparatus enabling the adjustment of the bed inventory such that the composition of the bed material may be kept in an optimal condition. Preferably, such an apparatus includes a furnace, a discharge port for removing exhaust gas with entrained solid particles from the furnace, a particle separator (preferably, a cyclone separator) connected to the discharge port for separating solid particles from the exhaust gas, the particle separator having an outlet for the exhaust gas connected to an exhaust gas duct and a solids outlet connected to a return duct for recycling the separated solid material back to the bottom of said furnace, and conducting a portion of the exhaust gas past the particle separator for decreasing the quantity of solid material entering the separator.

The conducting means advantageously comprises a bypass duct, having its first end connected upstream of the particle separator, and its second end connected to the exhaust gas duct downstream of the particle separator.

In a preferred embodiment of the present invention, the first end of the bypass duct is connected to the top of the furnace.

In another preferred embodiment of the present invention, the first end of the bypass duct is connected to the discharge duct between the top of the furnace and the particle separator.

Accordingly, the present invention advantageously provides a novel and an improved method and apparatus for adjusting the composition of the bed material so that the amount of bottom ash is maintained within acceptable limits.

The present invention brings about numerous advantages in addition to the already mentioned smaller and less expensive bottom ash treatment apparatus. For instance, it provides operational flexibility to the furnace and, thus, allows changing the bottom ash and fly ash proportions, it is easier to make changes in the fuel, the heat loss is less, and it may be used for controlling the temperature and/or heat transfer in the furnace.

The above brief description, as well as further objects, features, and advantages of the present invention will be more fully appreciated by reference to the following detailed description of the currently preferred, but nonetheless illustrative, embodiments of the present invention, taken in conjunction with the accompanying drawings.

DESCRIPTION OF THE PREFERRED EMBODIMENTS

Figure 1:
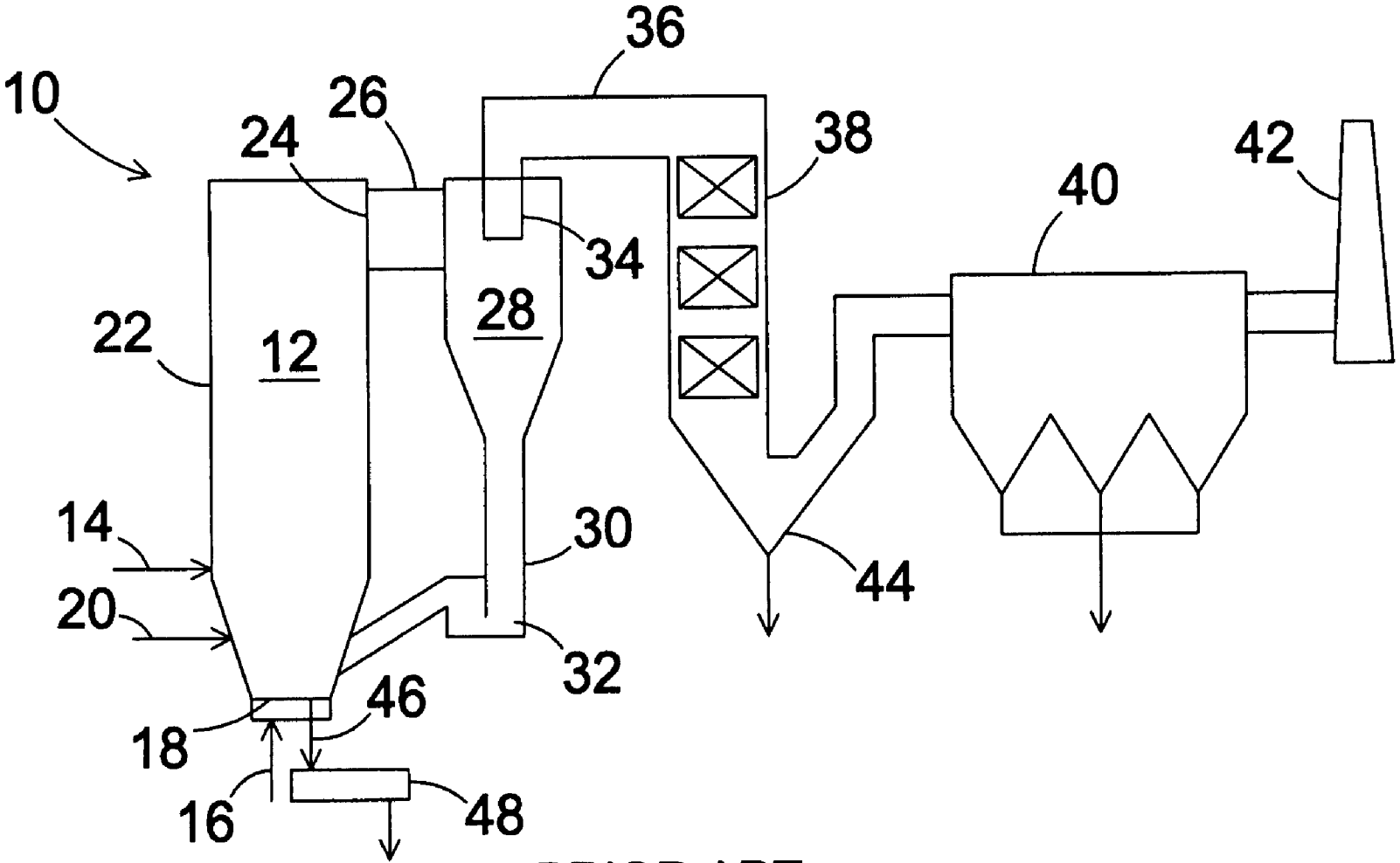
PRIOR ART Figure 1
FIG. 1 is a schematic, side elevational view of a circulating fluidized bed reactor illustrating the manner in which the exhaust gas is treated in prior art combustion processes.

Referring now in greater detail to the drawings, in FIG. 1, the overall schematic of a typical circulating fluidized bed reactor system 10 is shown. Particulate fuel, inert bed material, and possible auxiliary material, such as limestone, are introduced to the furnace 12 of the reactor system 10 by solid material feeders 14, such as screw feeders or pneumatic feeders. The solid materials form a bed, which is fluidized by primary gas 16 introduced through a bottom grid 18. In a circulating fluidized bed, the velocity of the fluidizing gas in the furnace is typically from about 4 m/s to about 9 m/s. The reactions, such as combustion, of the fuel are completed by secondary gas 20 introduced through the sidewalls 22 of the furnace 12.

The reactions in the furnace 12 produce gases, such as flue gases, which are discharged together with particles entrained with the gases from the furnace 12 through a discharge port 24 to a discharge duct 26, and further to a particle separator 28. In the particle separator 28, which is usually a cyclone separator, most (for example 99.9%) of the particles entrained with the exhaust gases are separated from the exhaust gases. The separated particles are conducted along a return duct 30 connected to the bottom of the separator 28 via a loop seal 32 back to the lower portion of the furnace 12.

Cleaned exhaust gases are discharged from the particle separator 28 through a central gas outlet 34, usually arranged at the top of the separator, to an exhaust gas duct 36. In the exhaust gas duct 36, the gases are usually conducted through a heat recovery area 38 and a dust separator 40 to a stack 42. The exhaust gas duct 36 may comprise further components, such as gas cleaning components, or the like, which are known to those skilled in the art, but such are not shown in FIG. 1.

A portion of the solid particles discharged from the furnace 12 through the discharge port 24—so-called fly ash—is not separated from the exhaust gases in the particle separator 28, but escapes through the gas outlet 34. A portion of the fly ash may be collected in a hopper 44 arranged in the exhaust gas duct 36, but most of it is collected by the dust separator 40. The portion of the solid material in the furnace 12 that does not escape through the gas outlet 34, is eventually discharged from the furnace as bottom ash 46. While the bottom ash is usually at a temperature of about 650 to about 850° C., it is cooled by a bottom ash cooler 48 to a lower temperature (e.g., about 300° C.), before it is discharged from the reactor 10.

Figure 2:
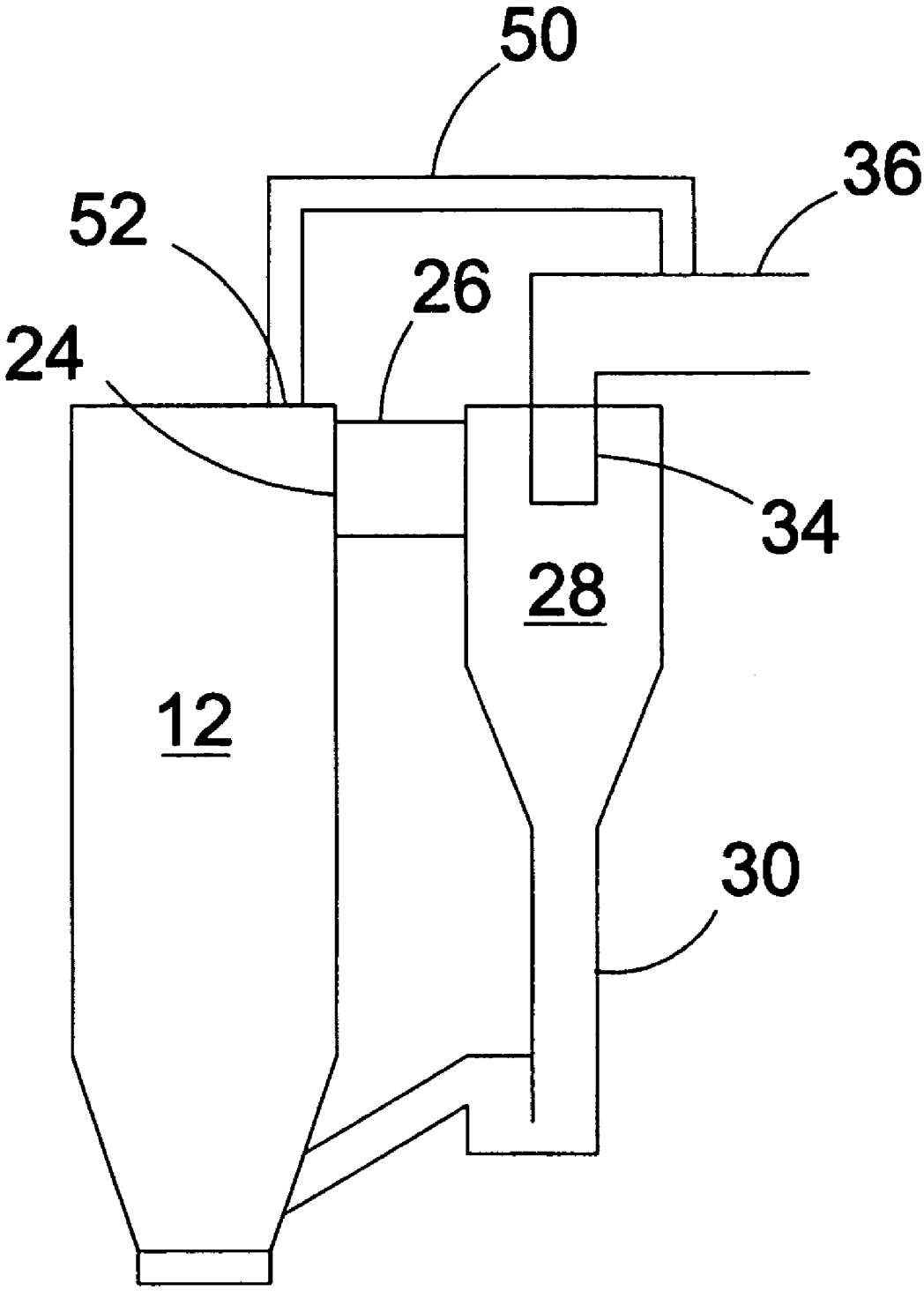
FIG. 2 is a schematic, side elevational view of the upper portion of a circulating fluidized bed reactor illustrating a preferred embodiment of the present invention.

In the first preferred embodiment of the present invention, schematically shown in FIG. 2, the furnace 12, the particle separator 28, the discharge duct 26 therebetween, the return duct 30, the gas outlet 34, and the upstream part of the exhaust gas duct 36 have been shown just like in FIG. 1. FIG. 2 also shows a bypass duct 50 coupled between the top of the furnace 12 and the exhaust gas duct 36. Due to the pressure difference between the furnace 12 and the exhaust gas duct 36, a stream of gas and entrained fine solids tends to flow through the duct 50, thus bypassing the particle separator 28.

In the embodiment shown in FIG. 2, the top of the furnace 12 is provided with another outlet opening 52 connected to the first end of the bypass duct 50. As another alternative, the first end of the bypass duct 50 may be connected to the same outlet 24 with the discharge duct 26 by, for instance, a branch pipe. As yet another alternative, the first end of the bypass duct 50 may be connected to the discharge duct 26 somewhere between the outlet opening 24 and the inlet into the particle separator 28.

Regardless of the exact position and structure of the bypass duct 50, the purpose of the bypass duct 50 is to receive a portion of the exhaust gases, and some solid particles entrained with the exhaust gases, from the furnace 12 and to take the received portion of the exhaust gas to the exhaust gas duct 36 downstream of the particle separator 28. By doing this, a portion of the solid particles are positively taken out of the fluidized bed circulation, and not returned back to the furnace 12. Thereby, the amount of fly ash, collected in the hopper 44 and the dust separator 40, is increased. Correspondingly, the amount of bed material circulating in the furnace 12 and the particle separator 28 is decreased. Eventually, also the amount of bottom ash 46, to be discharged from the bottom of the furnace 12, is decreased. In this embodiment, the sizing and geometry of the bypass duct 50 determine the quantity of solids taken to the cyclone separator outlet stream.

Figure 3:
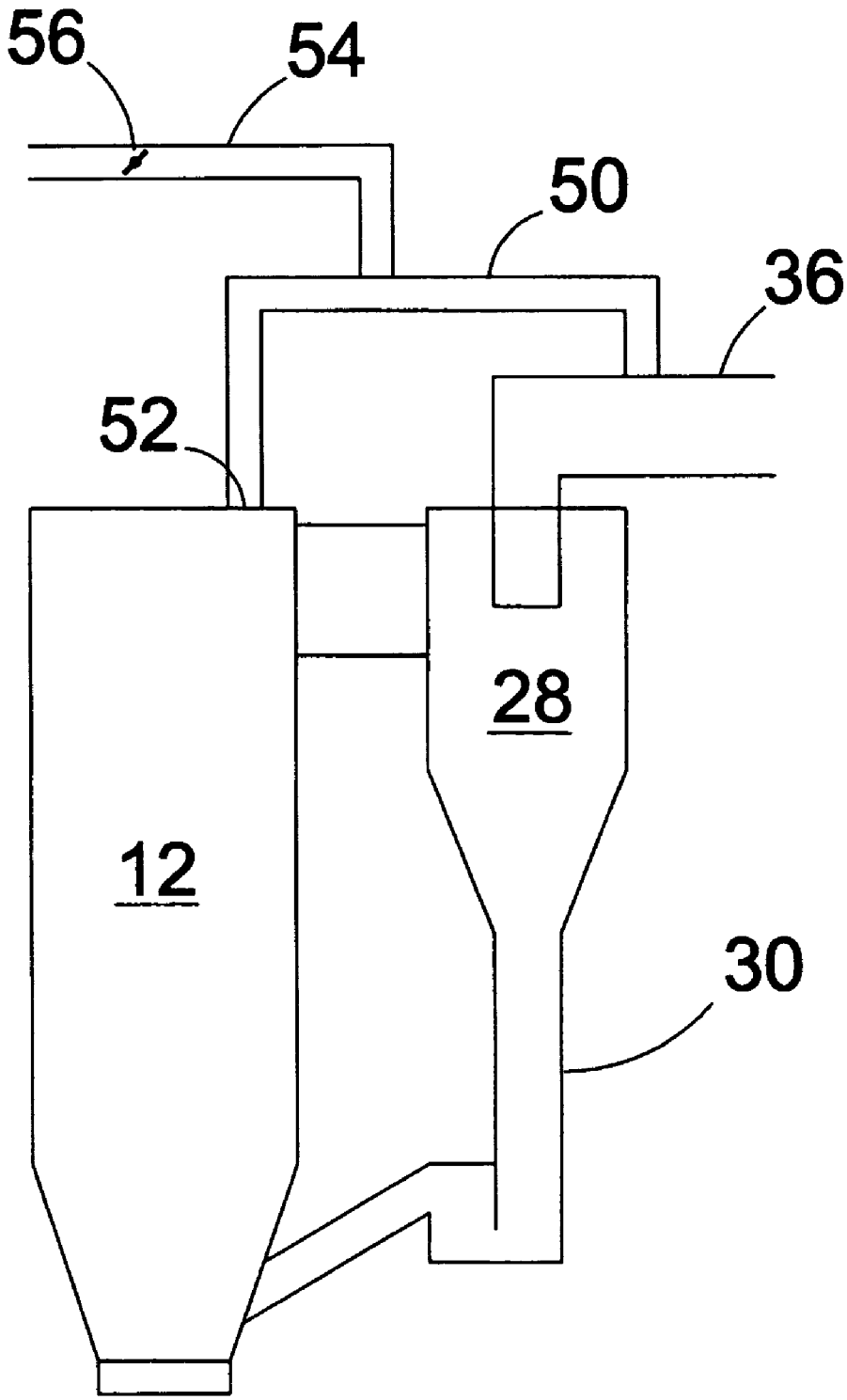
FIG. 3 is a schematic, side elevational view of the upper portion of a circulating fluidized bed reactor illustrating another preferred embodiment of the present invention.

Another preferred embodiment of the present invention is shown in FIG. 3. In this embodiment, the bypass duct 50 is provided with an additional means for controlling flow of the exhaust gas in the bypass duct 50. In this embodiment, the controlling means comprises gas piping 54 equipped with a control damper 56, such as a butterfly valve. The additional gas piping 54 is used for introducing gas, such as air, to the bypass duct 50 so as to decrease the amount of exhaust gases and solid particles flowing through the bypass duct 50 from the furnace 12 to the exhaust gas duct 36. By using the damper 56, the amount of introduced gas, and the amount of bypassing gas and particles, can be adjusted. When more gas is introduced via the gas piping 54, less exhaust gases and solid particles bypass the particle separator 28. The medium through piping 54 can be, for example, air or recirculated flue gas.

Figure 4:
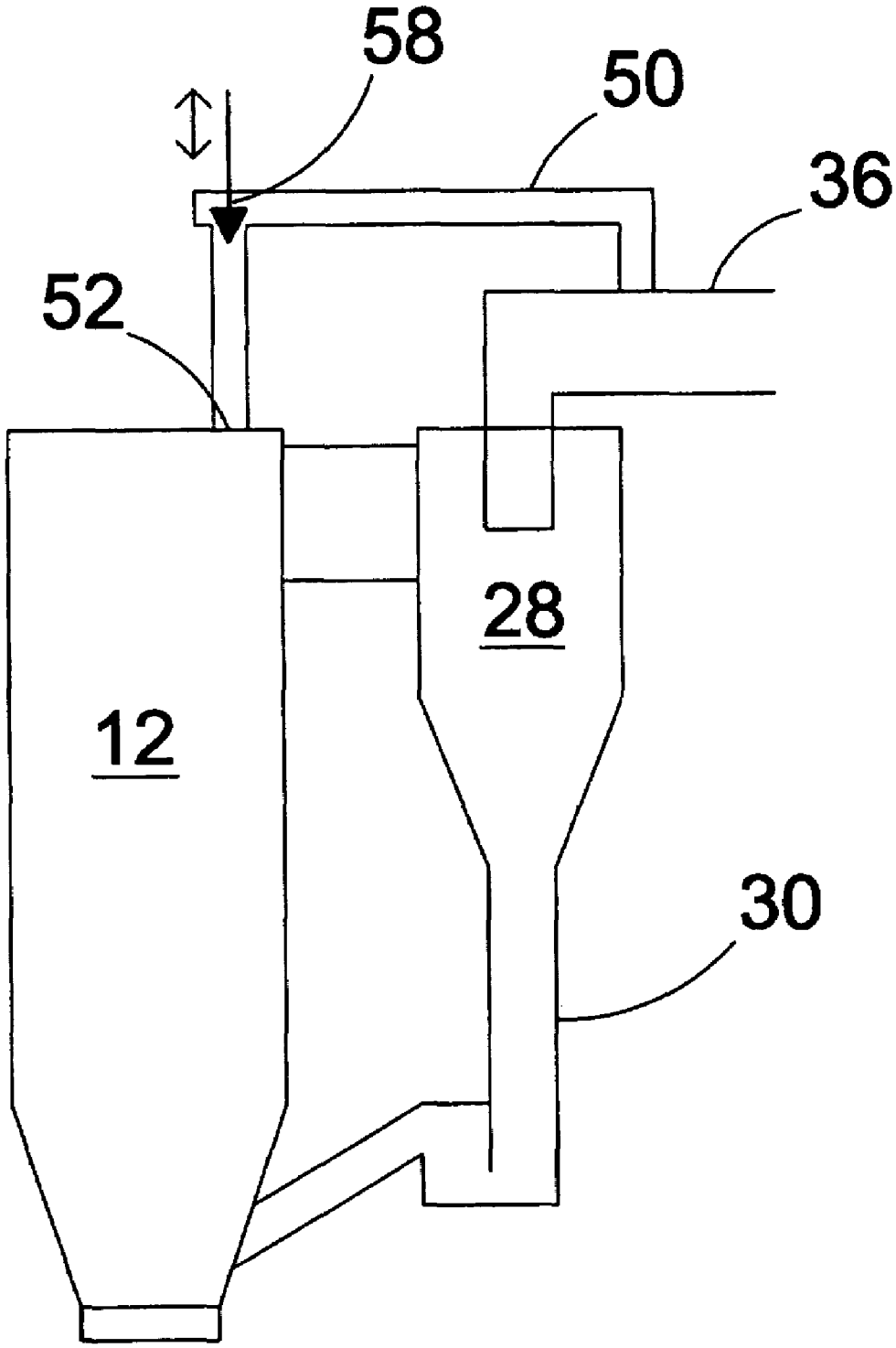
FIG. 4 is a schematic, side elevational view of the upper portion of a circulating fluidized bed reactor illustrating yet another preferred embodiment of the present invention.

Yet another preferred embodiment of the present invention is shown in FIG. 4. In this embodiment, the controlling means comprises a control valve 58 installed directly in the bypass duct 50. This embodiment gives the broadest possible flexibility, because, as the exhaust gas flows in, the bypass duct can be adjusted between totally blocked and fully open positions. Other suitable controlling means may include a passage and a port allowing exhaust gas and entrained particles to enter the flue gas channel upstream of the particle separator.

As will be readily apparent to those skilled in the art, the first end of the bypass duct could also be connected in various different ways upstream of the particle separator 28 in the embodiments of FIGS. 3 and 4, as was described above with reference to the embodiment shown in FIG. 2.

The result in the second and third embodiments, compared to the first one, is that the composition of the bed material can be better controlled. That is, the amount and particle size distribution of the bed material can be adjusted to better meet the demands of the fluidized bed process.

The bypass duct 50 may be manufactured of refractory lined pipes or conduits, or they may be pipes or components lined with an appropriate metal and/or ceramic material. It is self-evident that the lining has to endure both high temperature and high velocity of the solids. Suitable lining materials will be readily apparent to those skilled in the art.

While the invention has been described by way of examples of what are at present considered to be the preferred embodiments, it is to be understood that the invention is not limited to the disclosed embodiments, but is intended to cover various combinations or modifications of the features and applications included within the scope of the invention, as defined in the appended claims.

I claim:

1. A method of operating a circulating fluidized bed reactor having a furnace for combustion, a discharge port connected to the furnace for conducting combustion exhaust gas, a discharge duct connected to the discharge port, and a particle separator connected to the discharge duct for separating solid particles from the exhaust gas, wherein connected to the particle separator are a return duct connecting the particle separator to the furnace and an exhaust duct for discharging exhaust gas from the particle separator, the method comprising the steps of:

arranging a bypass duct connected to the furnace and the exhaust duct, wherein the bypass duct bypasses the particle separator;

conducting a partial flow of exhaust gas and solid particles entrained with the exhaust gas along the bypass duct for increasing the solid particle content in the exhaust gas after the particle separator, wherein the entrained particles are not returned back to the furnace; and controlling the exhaust gas flow in the bypass duct to adjust the quantity of solid particles bypassing the particle separator, wherein the exhaust gas flow in the bypass duct is controlled by feeding additional gas to the bypass duct.

2. The method as recited in claim 1, further comprising controlling the exhaust gas flow in the bypass duct by a control damper arranged in the bypass duct.

3. A circulating fluidized bed reactor, said reactor comprising:

a furnace having a fluidized bed of solid particles into which fuel and at least one gas are added for combustion;

a discharge port connected to the furnace for removing from the furnace exhaust gas with entrained particles resulting from the combustion;

a discharge duct connected to the discharge port;

a particle separator connected to the discharge duct for separating solid particles from the exhaust gas;

an exhaust gas outlet connected to the particle separator;

an exhaust gas duct connected to the exhaust gas outlet for discharging the exhaust gas from the particle separator;

a return duct connected to both the particle separator and the furnace for recycling the solids separated from the exhaust gas back to the furnace;

a separate bypass duct, having a first end connected upstream of the particle separator, and a second end connected to the exhaust gas duct downstream of the particle separator, for conducting a portion of the exhaust gas with entrained solid particles to bypass the particle separator, wherein the entrained particles are not returned back to the furnace, thereby decreasing the quantity of solid particles in the furnace; and controlling means, provided in the bypass duct, for controlling the flow of exhaust gas in the bypass duct, wherein said controlling means comprises additional gas piping introducing gas into the bypass duct.

4. The apparatus as recited in claim 3, wherein the additional gas piping is provided with means for adjusting the quantity of gas introduced into the bypass duct.

5. The apparatus as recited in claim 3, wherein said first end of said bypass duct is connected to a top of said furnace.

6. The apparatus as recited in claim 3, wherein said first end of said bypass duct is connected to said discharge duct between a top of said furnace and said particle separator.

7. The apparatus as recited in claim 3, wherein said controlling means comprises a control damper arranged in said bypass duct.

8. The apparatus as recited in claim 3, wherein said bypass duct is lined to endure both the temperature and the solids flowing in said bypass duct.

9. The apparatus as recited in claim 3, wherein said particle separator is a cyclone separator.

* * * * *